United States Patent [19]

Tsuchihashi et al.

[11] Patent Number: 4,825,908

[45] Date of Patent: May 2, 1989

[54] FOUR-WAY VALVE

[75] Inventors: Tsuneyuki Tsuchihashi; Nobuaki Itoh, both of Hiratsuka, Japan

[73] Assignee: Yokohama Aeroquip Corporation, Tokyo, Japan

[21] Appl. No.: 187,291

[22] Filed: Apr. 28, 1988

[30] Foreign Application Priority Data

Apr. 28, 1987 [JP] Japan ..... 62-63559[U]

[51] Int. Cl.[4] ..... F25B 13/00

[52] U.S. Cl. ..... 137/625.43; 137/625.46; 251/129.01; 251/287

[58] Field of Search ..... 137/625.43, 625.46, 137/311; 251/129.01, 129.11, 65, 287

[56] References Cited

U.S. PATENT DOCUMENTS

| | | | |
|---|---|---|---|
| 2,271,331 | 1/1942 | Elliott | 137/625.43 X |
| 2,519,574 | 8/1950 | Holl | 137/625.43 |
| 2,745,434 | 5/1956 | Stevenson | 137/625.43 |
| 2,855,000 | 10/1958 | Van Allen et al. | 137/625.43 |
| 3,796,232 | 3/1974 | Dalton | 137/625.43 X |
| 3,949,967 | 4/1976 | Kratfel | 137/625.46 X |
| 4,139,355 | 2/1979 | Turner et al. | 137/625.43 X |
| 4,286,625 | 9/1981 | Tomlin et al. | 251/287 |
| 4,311,020 | 1/1982 | Tobin et al. | 137/625.43 X |
| 4,561,629 | 12/1985 | Idogaki et al. | 251/65 |

FOREIGN PATENT DOCUMENTS

| | | | |
|---|---|---|---|
| 0151674 | 8/1984 | Japan | 137/625.43 |
| 2073371 | 10/1981 | United Kingdom | 137/625.43 |

*Primary Examiner*—John Rivell

*Attorney, Agent, or Firm*—Birch, Stewart, Kolasch & Birch

[57] ABSTRACT

Herein disclosed is a four-way valve for switching the cooling and heating modes of an air conditioner. The four-way valve includes: a first valve body of a cup shape having its closed wall formed with an outlet port and two circuit ports. A second valve body is provided having its root fitted fixedly on the first valve body and an inlet port formed at the side opposite to the body root. A cylindrical valve member is fitted rotatably in the first valve body having its one half formed in its end portion with an arcuate groove for providing alternate communication between the outlet port and the circuit ports and its other half formed with two communication ports. A member is provided for restricting the rotations of the cylindrical valve member. A magnetic member is provided for magnetically rotating the valve member when energized. A collar is disposed on the valve member and made irrotational but movable in the axial direction. A retainer is disposed on the open end of the first valve body for retaining the valve member. An urging member urges the valve member toward the first valve body through the collar.

4 Claims, 4 Drawing Sheets

FOUR-WAY VALVE

BACKGROUND OF THE INVENTION

1. Field of the Invention

The present invention relates to a four-way valve to be used mainly for switching the cooling and heating modes of an air conditioner.

2. Description of the Prior Art

In the refrigerating cycle of the air conditioner, there has been used the four-way valve for switching the direction of flow of a cooling medium for the cooling and heating operations. As the four-way valve of this kind, a mechanism shown in FIG. 6 has been proposed by Japanese Utility Model Laid-Open No. 54-165324 or Japanese- Patent Laid-Open No. 61-6468.

According to this proposal, there is connected to a valve body 1 an inlet passage 2 which leads to the discharge port of a compressor A. To the opposite side of the valve body 1, there are connected an output passage 3 leading to the suction port of the compressor A; a first passage 4 leading to an outdoor heat exchanger $E_1$; and a second passage 5 leading to an indoor heat exchanger $E_2$. In the valve body 1, there is fitted a bowl-shaped valve member 6 which is arranged slidably on a valve seat 8 opening the aforementioned three passages 3, 4 and 5 therein. The valve member 6 has its two sides connected to pistons 7*a* and 7*b* which have orifices 7*c*. These pistons 7*a* and 7*b* define, at the two end portions of the valve body 1, two chambers which have communication with the two side portion of a central valve seat 10*a* of a pilot valve member 10 by way of pilot tubes 9*a* and 9*b*. The outlet passage 3 has communication with the central portion of the valve seat 10*a* by way of another pilot tube 9*c*. In the valve member 10, there is fitted a pilot valve 10*b* which is actuated by an electromagnet M.

FIG. 6 shows the state of the cooling mode, in which communication is established between the pilot tubes 9*b* and 9*c* to drop pressure in the lefthand end portion of the valve body 1 so that the valve member 6 is moved to the left. In this state, the gases emanating under a high pressure from the compressor A are introduced from the inlet passage 2 to flow via the first passage 4, the outdoor heat exchanger $E_1$, a capillary tube C and the indoor heat exchanger $E_2$ until they are returned from the second passage 5 to the compressor A via the internal passage of the valve member 6 and the outlet passage 3.

If, in this state, the coil of the electromagnet M is energized, the pilot valve 10*b* is moved to the right to close the lefthand pilot tube 9*b*. Simultaneously with this, the central pilot tube 9*c* leading to the outlet pipe 3 communicates with the righthand tube 9*a* so that the lefthand end chamber of the valve body 1 takes a higher pressure than that of the righthand end chamber to move the valve member 6 to the right. As a result, the circuit is switched to the heating mode in which the inlet passage 2 communicates with the second passage 5 and in which the outlet passage 3 communicates with the first passage 4. If, on the other hand, the power supply to the coil is interrupted, the circuit restores the cooling mode of FIG. 6.

The four-way valve of the prior art thus far described is constructed of the main valve member for switching the circuit and the pilot valve member for actuating the main valve member and requires the piping connecting the two valve member. Moreover, the main valve member is of the reciprocating type having the paired pistons so that its construction is complicated with the increased number of parts and encountered by troubles when assembled. For the operations in the heating mode in window, still moreover, the power has to be supplied for maintaining the pilot valve so that the four-way valve of the prior art is uneconomically accompanied by much power consumption.

SUMMARY OF THE INVENTION

It is, therefore, an object of the present invention to provide an economical four-way valve which requires neither any pilot valve nor piping therefor so that it can be easily assembled with the simple construction and which need not supply an electric power continuously to an electromagnet.

In order to achieve the above-specified object, according to the present invention, there is provided a four-way valve comprising a first valve body of a cup shape having its closed wall formed with an outlet port and two circuit ports; a second valve body having its root fitted fixedly on said first valve body and an inlet port formed at the side opposite to said root; a cylindrical valve member fitted rotatably in said first valve body having its one half formed in its end portion with an arcuate groove for providing alternate communication between said outlet port and said circuit ports and its other half formed with two communication ports; means for restricting the rotations of said cylindrical valve member; magnetic means for magnetically rotating said valve member when energized; a collar disposed on said valve member and made irrotational but movable in the axial direction; a retainer disposed on the open end of said first valve body for retaining said valve member; and urging means for urging said valve member toward said first valve body through said collar.

For the operations in the cooling mode, the inlet port is connected with the discharge side of the compressor whereas the outlet port is connected with the suction side of the same, and one of the circuit ports is connected to the outdoor heat exchanger whereas the other circuit port is connected to the indoor heat exchanger. With these connections, the cooling gases emanating under a high pressure from the compressor enter the valve body from the inlet port to flow towards the outdoor heat exchanger via one of the communication port and the circuit port of the valve member. After one circulation, the cooling gases return to the valve member from the other circuit port and flow out from the outlet port to the suction side of the compressor by way of the arcuate return groove. In this meanwhile, the valve member is maintained in a fixed state by the attractions of the permanent magnets and the yoke of the electromagnet.

If, in this state, the coil of the electromagnet is supplied with DC current, the same polarities as those of the permanent magnets on the valve member are established so that the valve member are rotated counterclockwise within a predetermined range by the mutual repulsions. As a result, the arcuate groove of the valve member is switched to establish the communication between the inlet port and the other circuit port and the communication between the other communication port and one circuit port. Thus, the mode is switched to the heating operations, in which the cooling gases emanating from the compressor first flow to the indoor heat exchanger. Even if the power supply to the coil is interrupted immediately after the switching, the valve member is maintained in the fixed position by the attractions of the permanent magnets.

BRIEF DESCRIPTION OF THE DRAWINGS

Other objects, features and advantages of the present invention will become apparent from the following description taken with reference to the accompanying drawings, in which:

FIG. 3(B) is a perspective view of a valve member or the like;

DESCRIPTION OF THE PREFERRED EMBODIMENT

The present invention will be described in the following in connection with the embodiment thereof with reference to the accompanying drawings.

Figure 1:
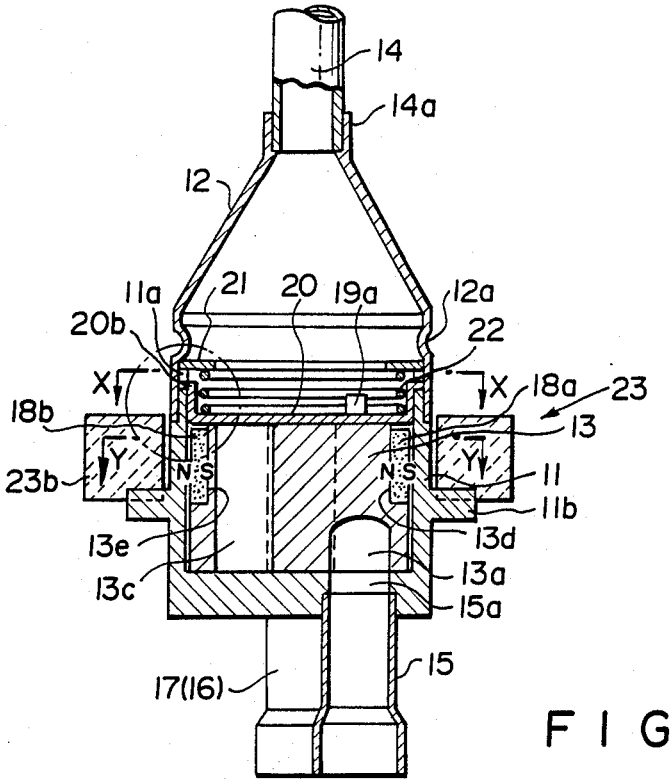
FIG. 1 is a sectional view showing a four-way valve according to one embodiment of the present invention.
Figure 2:
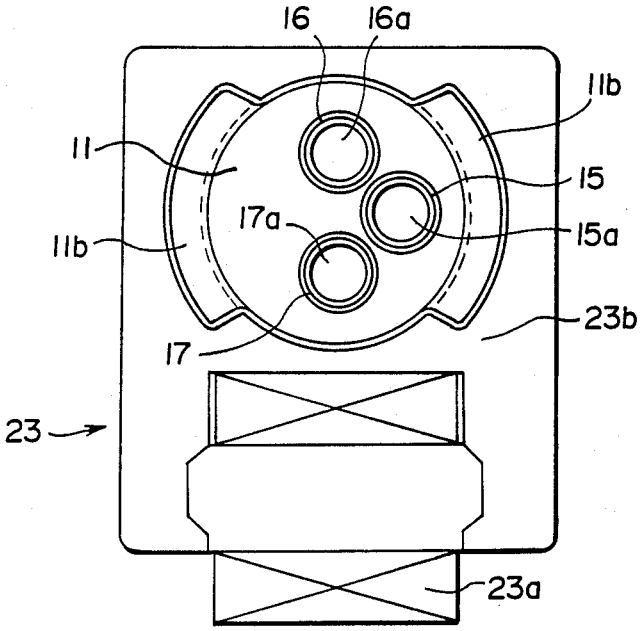
FIG. 2 is a bottom view showing the four-way valve of FIG. 1.
Figure 5:
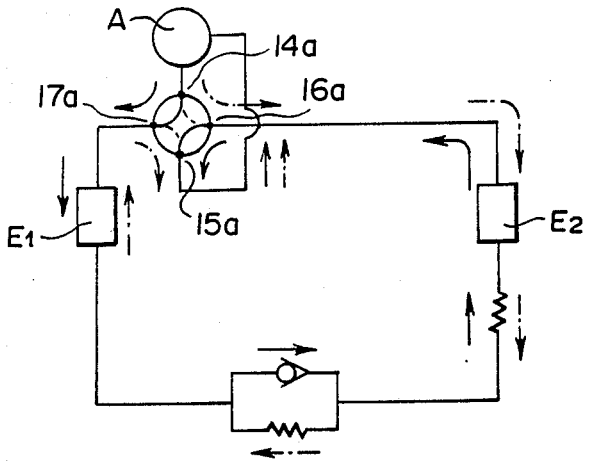
FIG. 5 is a circuit diagram showing an air conditioner incorporating the four-way valve of the present invention.
Figure 6:
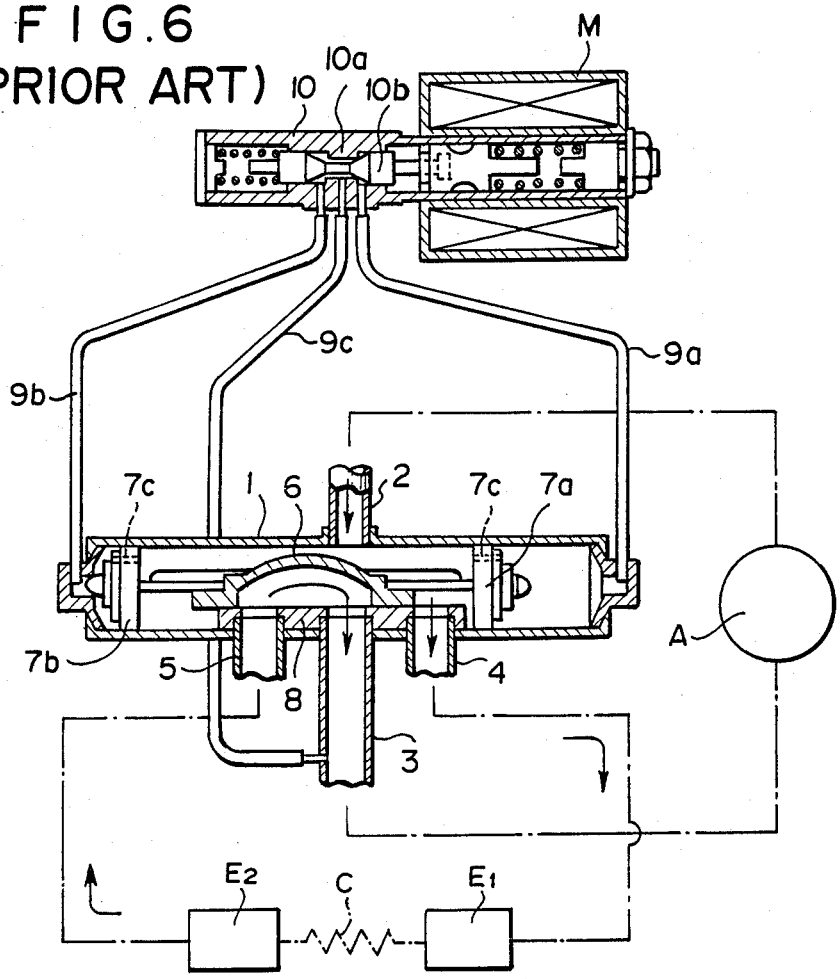
FIG.6 (PRIOR ART)
FIG. 6 is a sectional view showing the four-way valve according to the prior art.

As illustrated in FIGS. 1 and 2 a first valve body 11 is formed into a cup shape having its upper end opened. The valve body 11 has its bottom wall formed with an outlet port 15*a* and two circuit ports 16*a* and 17*a* which are arranged on a common circle such that the two circuit ports 16*a* and 17*a* are spaced by a predetermined angle (e.g., 90 degrees, as seen from FIG. 2) from the outlet port 15*a*. The upper open end of the first valve body 11 is thinned to fixedly fit therein the root portion of a second valve body 12 which is drawn into a conical shape to have an inlet port 14*a* at its upper end. An inlet pipe 14 leading to the discharge side of a compressor A (as shown in FIG. 5) is connected to that inlet port 14*a*, and an outlet pipe 15 leading to the suction side of the same is connected to the outlet port 15*a* of the first valve body 11. Moreover, one circuit port 16*a* is connected to a conduit 16 leading to an indoor heat exchanger $E_2$, and the other circuit port 17*a* is connected to a conduit 17 leading to an outdoor heat exchanger $E_1$.

Figure 3A:
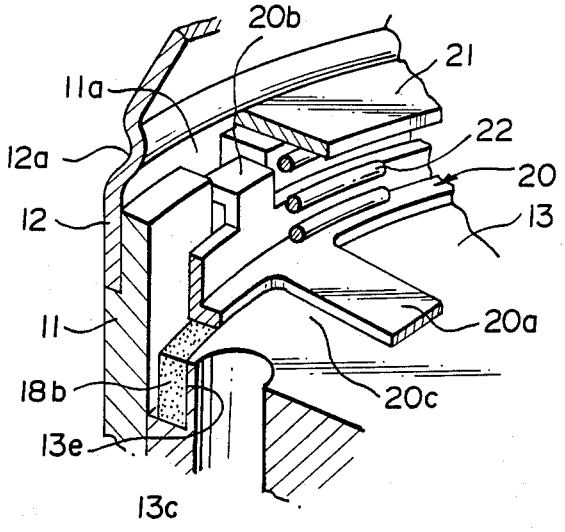
FIG. 3(A) is an enlarged perspective view showing the encircled portion of FIG. 1.
Figure 3B:
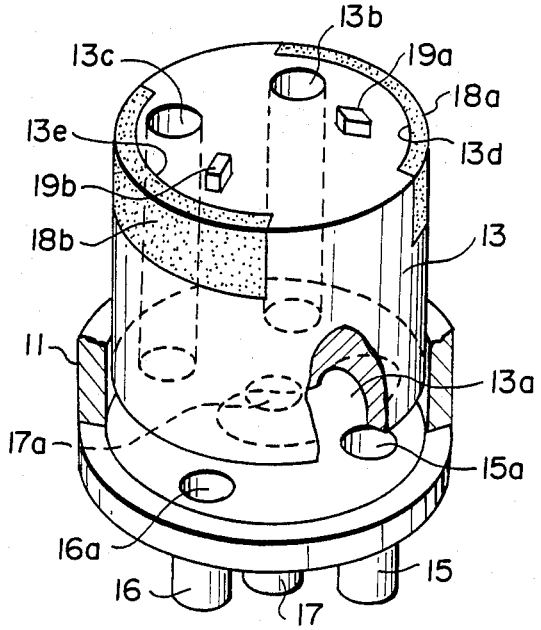

A cylindrical valve member 13 is rotatably fitted in the valve body 11. The valve member 13 is formed in its bottom with an arcuate groove 13*a*, as seen from FIG. 3(B), for providing communication between the outlet port 15*a* formed in the valve body 11 and the circuit port 16*a* or 17*a*. The opposite or upper half of the valve member 13 to that of the arcuate groove 13*a* is formed with two communication ports 13*b* and 13*c* which are arranged on the same circle and at the same spacing as those of the outlet port 15*a* and the circuit port 16*a* or 17*a*. The upper half of the valve member 13 is further formed with arcuate cut-away portions 13*d* and 13*e* of a predetermined length, which are arranged in diametrically symmetric positions. In these cut-away portions 13*d* and 13*e* respectively, there are fixed permanent magnets 18*a* and 18*b* which have different polarities. The upper surface of the valve member 13 is formed thereon with two stoppers 19*a* and 19*b* which are positioned to correspond to the two ends of the arcuate groove 13*a* in the bottom for controlling the angle of rotation.

On the upper surface of the valve member 13, there is arranged a collar 20. As better seen from FIGS. 3(A) and 4(A), this collar 20 is formed into such a dish shape that includes a diametrical band 20*a* formed at its bottom center for retaining the stoppers 19*a* and 19*b* and two generally semicircular holes 20*c* extending at the two sides of the diametrical band 20*a*. The circumferential wall of the dish-shaped collar 20 is formed with a pair of ears or hooks 20*b* which are located at the extensions of the diametrical band 20*a*. The hooks 20*b* are adapted to engage with notches 11*a* which are formed in the thin portion near the open end of the valve body 11, thus allowing the collar 20 to move irrotationally only in the axial direction.

Over the open end of the first valve body 11, on the other hand, there is disposed an annular retainer 21 which is clamped between that open end and an annular recess 12*a* formed in the root of the second valve body 12. Between the retainer 21 and the collar 20, there is disposed a coil spring 22 which has a predetermined strength for urging the valve member 13 toward the first valve body 11 through the collar 20.

Around the outer circumference of the upper portion of the first valve body 11, moreover, there is fitted a rectangular yoke (or iron core) 23*b* of an electromagnet 23 which is connected with a DC power source. The magnet yoke 23*b* is irrotationally supported by a bulging flange 11*b* which is formed on the outer circumference of the central portion of the valve body 11. While no power is supplied to the coil 23*a* of the electromagnet 23, the valve member 13 is held in an immovable state both by the attraction, which is established between the yoke 23*b* and the permanent magnets 18*a* and 18*b* mounted on the two sides of the outer circumference of the upper half of the valve member 13, and by the urging force of the coil spring 22. When, on the other hand, the power is supplied to the coil 23*a* so that the portions of the yoke 23*b* facing the permanent magnets 18*a* and 18*b* may acquire the same polarities as those of the magnets 18*a* and 18*b*, the valve member 13 is rotated by the mutual repulsions.

Figure 4A:
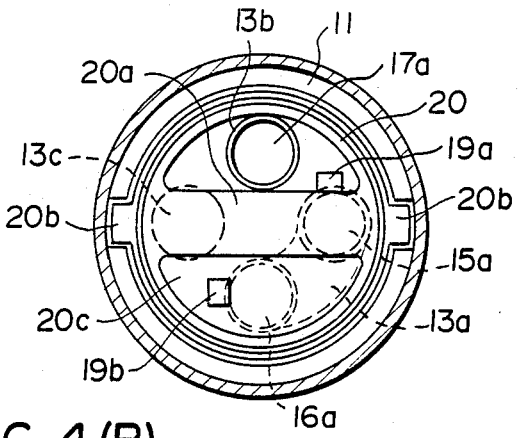
FIG. 4(A) is a section taken along line X—X of FIG. 1.
Figure 4B:
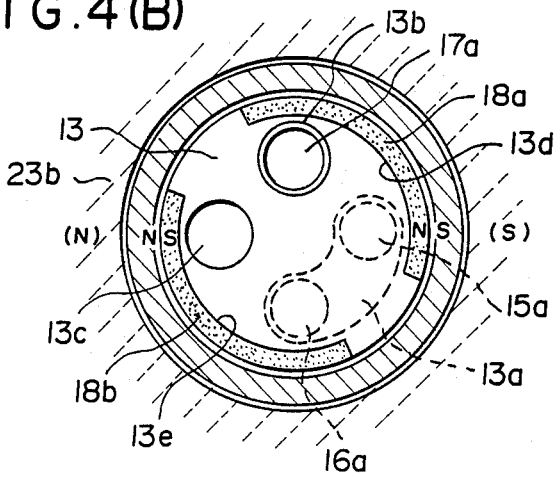
FIG. 4(B) is similar to FIG. 4(A) but taken along line Y—Y of FIG. 1 and shows the state before the switching.

The operations of the four-way valve thus constructed will be described in the following. FIGS. 1 and 4(A) and 4(B) show the state in which the valve member 13 is set for cooling operations. In this state, one stopper 19*a* on the upper surface of the valve member 13 is in abutment against one side of the diametrical band 20*a* of the collar 20 so that the arcuate groove 13*a* in the bottom of the valve member provides communication between the outlet port 15*a* in the bottom of the first valve body 11 and the communication port 16*a* leading to the indoor heat exchanger $E_2$. On the other hand, the other communication port 13*b* of the valve member 13 is aligned with the circuit port 17*a* of the first valve body 11 leading to the outdoor heat exchanger $E_1$. As a result, the cooling medium gases emanating from the compressor A under a high pressure enter the second valve body 12 via the inlet pipe 14 and flow via the communication port 13*b* and the circuit port 17*a* to the outdoor heat exchanger $E_1$, as shown by solid arrows in FIG. 5, until they are returned via the arcuate groove 13*a* of the valve member and the outlet port 15*a* of the valve body 11 to the compressor A.

Figure 4C:
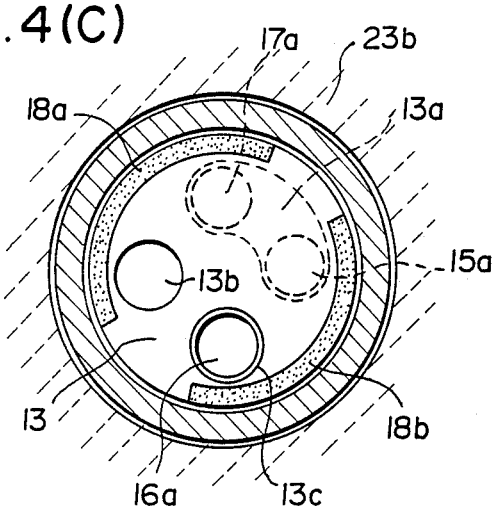
FIG. 4(C) is similar to FIGS. 4(A) and 4(B) but shows the state after the switching.

In this state, the coil 23*a* of the electromagnet 23 is supplied with the DC current such that the portions of the yoke 23*b* facing the permanent magnets 18*a* and 18*b* on the valve member 13 take the same polarities as those of the permanent magnets 18*a* and 18*b* as better seen from FIG. 4(B). Then, the valve member 13 is rotated counter-clockwise by the mutual repulsions to bring the other stopper 19*b* on the upper surface into engagement with the other side of the diametrical band 20*a* of the collar 20. As a result, the arcuate groove 13*a* of the valve member 13 establishes communication between the outlet port 15*a* of the first valve body 11 and the circuit port 17*a* leading to the outdoor heat exchanger $E_1$, as better seen from FIG. 4(C), and the other communication port 13*c* of the valve member 13 is switched into alignment with the circuit port 16*a* leading to the indoor heat exchanger $E_2$. Then, the high-pressure gases emanating from the compressor A are introduced from the inlet pipe 14 to flow in the circuit of FIG. 5, as indicated by dotted arrows, via the communication port 13*c* of the valve member 13 and the circuit port 16*a* of the valve body 11 so that the state is changed into heating operations. Even if, moreover, the power supply to the coil 23*a* is interrupted immediately after the switching, the valve member 13 is kept irrotational both by the attractions of the permanent magnets 18*a* and 18*b* and the yoke 23*b* and by the urging force of the coil spring 22 so that the mode of heating run is maintained.

If, in this state, the flow of the DC current to the coil 23*a* of the magnet 23 is reversed by another switching action, the valve member 13 is rotated in the opposite direction to restore the mode of cooling run of FIG. 4(B).

Although the embodiment has the valve bodies and member arranged upright or in vertical positions, as shown, they may be arranged horizontally.

On the other hand, the four-way valve of the present invention can be applied not only to the refrigerating cycle of an air conditioner but also a switch for switching the circuit of another hydraulic system.

The four-way valve thus constructed according to the present invention need neither the switching pilot valve nor the piping for the valve bodies but can be constructed simply with a reduced number of parts and assembled with ease so that it can be produced at a reasonable cost. Since, moreover, the valve body is rotated and kept irrotational by the interactions between the paired permanent magnets of different polarities and the surrounding electromagnet, it is sufficient to supply the power to the electromagnets only at the circuit switching instant. As a result, the power consumption can be economically reduced, and there is no possibility of damages and accidents which might otherwise be caused by the rise in the coil temperature.

What is claimed is:

1. A four-way valve comprising:

a first valve body of a cup shape having a closed wall formed with an outlet port and two circuit ports;

a second valve body having a root fitted fixedly on said first valve body and an inlet port formed at the side opposite to said root;

a cylindrical valve member fitted rotatably in said first valve body having an end portion with an arcuate groove for providing alternate communication between said outlet port and said circuit ports and two axially extending communication ports;

means for restriction rotation of said cylindrical valve member;

magnetic means for rotating said valve member when energized;

a collar disposed on said first valve body and made irrotational but movable in the axial direction;

a retainer disposed on the open end of said first valve body for retaining said valve member; and urging means for urging said valve member toward said first valve body through said collar.

2. A four-way valve according to claim 1, wherein said restricting means includes two stoppers formed on the opposite end of said valve member to said annular groove and positioned to correspond to opposite ends of said arcuate groove; and a diametrical band formed at the center of the bottom of said collar for engaging with one of said stoppers to stop rotation of said valve member.

3. A four-way valve according to claim 1, wherein said magnetic means includes two permanent magnets of different polarities arranged diametrically on the outer circumference of said valve member; and an electromagnet having a yoke fitted on the outer circumference of said first valve body to surround said permanent magnets.

4. A four-way valve according to claim 1, wherein said urging means is a coil spring sandwiched between said collar and said retainer.

* * * * *